US006615525B1

(12) United States Patent
Chang

(10) Patent No.: US 6,615,525 B1
(45) Date of Patent: Sep. 9, 2003

(54) MULTI-DISPLAY MODE PICTURE FRAME

(76) Inventor: Jung-Shih Chang, No. 32, Lane 25, Li Min Street, Ta Li City, Taichung Hsien (TW)

( * ) Notice: Subject to any disclaimer, the term of this patent is extended or adjusted under 35 U.S.C. 154(b) by 0 days.

(21) Appl. No.: 10/177,926

(22) Filed: Jun. 24, 2002

(30) Foreign Application Priority Data

Apr. 17, 2002 (CN) ..... 02230798

(51) Int. Cl.[7] ..... A47G 1/06; G09F 1/12
(52) U.S. Cl. ..... 40/762; 40/745
(58) Field of Search ..... 40/745, 748, 762

(56) References Cited

U.S. PATENT DOCUMENTS 2,450,495 A * 10/1948 Ullman ..... 40/745
3,546,802 A * 12/1970 Preston ..... 40/745
5,075,991 A * 12/1991 Wenkman et al. ..... 40/745

* cited by examiner

*Primary Examiner*—Cassandra Davis
(74) *Attorney, Agent, or Firm*—Browdy and Neimark, P.L.L.C.

(57) ABSTRACT

A multi display mode picture frame is constructed to include a flat rectangular frame base and a back support. The frame base has a front side adapted for holding a picture, at least one first mounting hole and at lest one second mounting hole in a back side thereof, each first mounting hole being spaced between the center of the back side and the mid point of one short peripheral side, each second mounting hole being spaced between the center of the back side and the mid point of one long peripheral side. The back support has a first end detachably coupled to one mounting hole of the frame base and a second end forming with one peripheral side of the frame base a triangle that supports the picture frame on a flat surface.

11 Claims, 7 Drawing Sheets

MULTI-DISPLAY MODE PICTURE FRAME

FIELD OF THE INVENTION

The present invention relates to a picture frame for holding pictures and, more specifically, to a multi display mode picture frame.

BACKGROUND OF THE INVENTION

A picture frame may be hung on the wall or supported on the top of a table to hold a picture. For hanging on a nail in the wall, a picture frame is provided with a hanging hole or hanging hook at the back side. For supporting on the top of a table, a picture frame is provided with a foldaway back support. When not in use, the foldaway back support is turned inwards and closely attached to the back side of the picture frame. When in use, the foldaway back support is turned outwards from the back side of the picture frame for supporting the picture frame on the top of a table in a tilted position. Furthermore, a conventional picture frame provides only one display mode, i.e., a picture frame designed for hanging on the wall cannot be supported on the top of a table in vertical; a picture frame designed for supporting on the top of a table in vertical cannot be hung on the wall. Conventional picture frames of either mounting type are designed to hold a picture exclusively in the transverse or longitudinal position. If the hanging hole or hanging hook of a rectangular picture frame is provided at the mid point of one short side, the picture frame can only be hung on the wall longitudinally, i.e., the picture frame is not suitable for holding a transverse picture. Similarly, the foldaway back support of a picture frame can support the picture frame exclusively in the longitudinal or transverse direction only. Further, when mounting a longitudinal picture in a picture frame designed for display a longitudinal picture, the user must look at the relative direction between the picture and the picture frame, preventing inverted loading of the picture in the picture frame.

SUMMARY OF THE INVENTION

It is one object of the present invention to provide a multi display mode picture frame, which can be hung on the wall or supported on the top of a table either in longitudinal direction or transverse direction as desired.

It is another object of the present invention to provide a multi display mode picture frame, which enables the user to mount the picture without considering the insertion direction of the picture relative to the picture frame.

To achieve these objects of the present invention, the multi display mode picture frame comprises a flat rectangular frame base and a back support. The frame base has two parallel long peripheral sides, two parallel short peripheral sides, a front side adapted for holding a picture, a back side, one first mounting hole spaced between the center of the back side and the mid point of one short peripheral side, and one second mounting hole spaced between the center of the back side and the mid point of one long peripheral side. By means of the mounting holes of the frame base, the frame base can be hung on a nail in the wall in longitudinal or transverse direction as desired. The back support has a coupling portion at one end thereof detachably coupled to one of the mounting holes, thereby enabling said back support to be extended from the corresponding mounting hole toward one peripheral side of said frame base such that the picture frame can be supported on a flat surface by means of the other end of the back support and the peripheral side of said frame base.

According to an embodiment of the present invention, the frame base is made having two first mounting holes respectively bilaterally spaced between the center of the back side and the mid points of the short peripheral sides, and two second mounting holes respectively bilaterally spaced between the center of the back side and the mid points of the long peripheral sides.

DETAILED DESCRIPTION OF THE INVENTION

Figure 1:
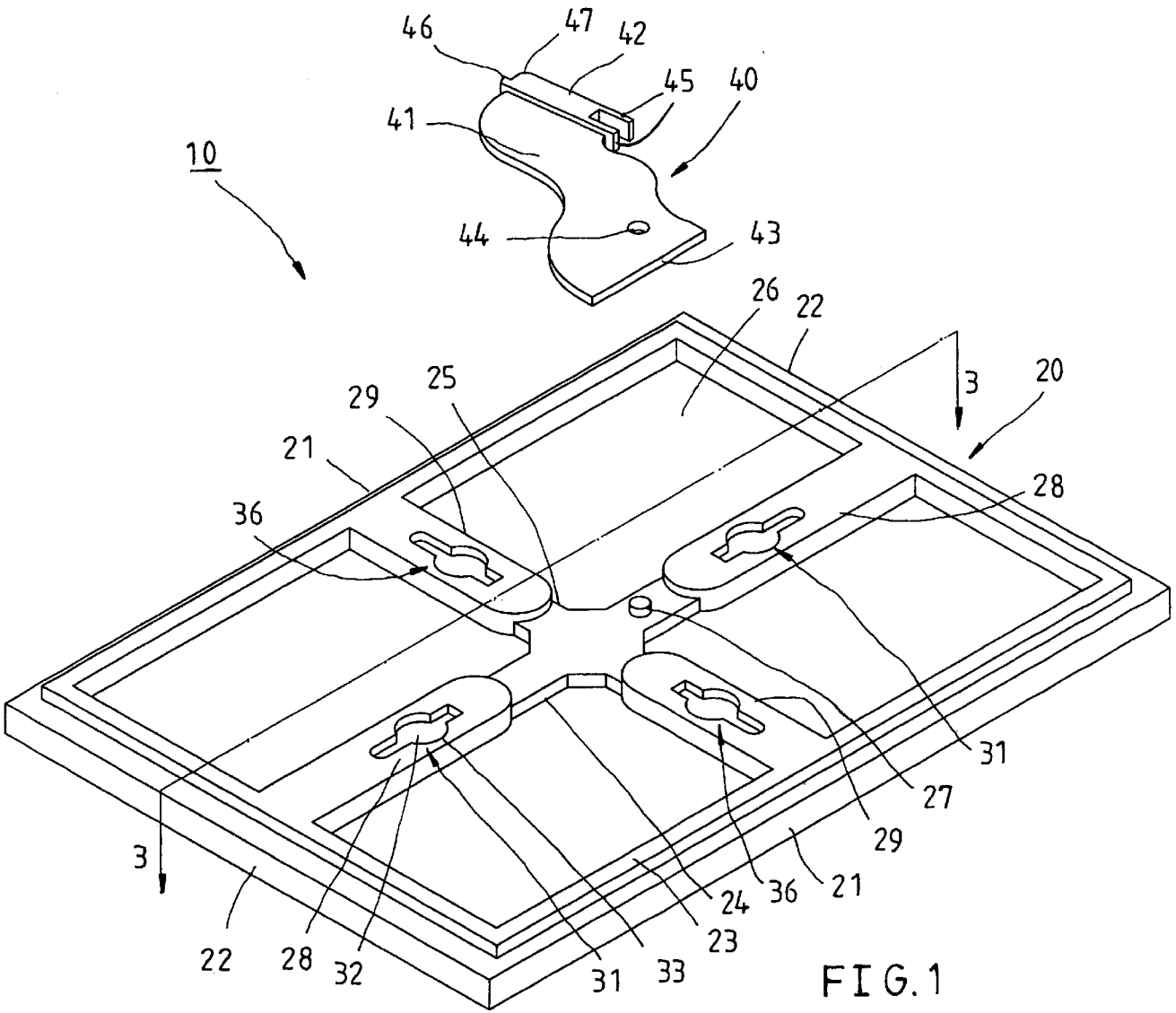
FIG. 1 is an exploded view of a picture frame according to a first preferred embodiment of the present invention.

Referring to FIGS. from 1 through 3, a picture frame 10 is shown in accordance with a first preferred embodiment of the present invention, comprised of a frame base 20, and a back support 40.

Figure 3:
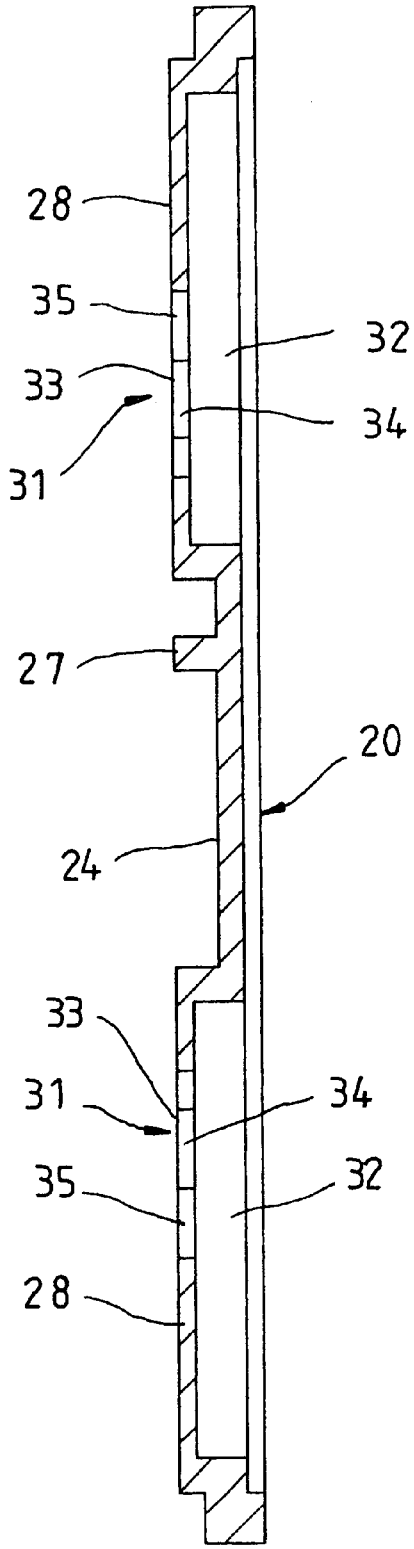
FIG. 3 is a sectional view taken along line 3—3 of FIG. 1.

The frame base 20 is a flat, rectangular member injection-molded from plastics having two parallel long peripheral sides 21 and two parallel short peripheral sides 22. The front side (the right side in FIG. 3) of the frame base 20 is adapted for holding a picture or pictures (because the arrangement of the, picture .or pictures in the front side of the frame base 20 is not within the scope of the claims of the present invention, no further detailed description in this regard is necessary). The frame base 20 further comprises a flange 23 protruded from the back side and extended along the border, a long rib 24 protruded from the back side in parallel to the long peripheral sides 21, and a short rib 25 protruded from the back side in parallel to the short peripheral sides 22 and intersected with the long rib 24 at the center of the frame base 20. The long rib 24 and the short rib 25 define with the flange 23 four recessed portions 26 in the back side of the base frame 20. The long rib 24 has a peg 27 protruded from the surface thereof adjacent to the center of the frame base 20.

Two first protruded blocks 28 are respectively formed integral with the ends of the long rib 24. The first protruded blocks 28 are narrow flat blocks extended along the length of the long rib 24. Two second protruded blocks 29 are respectively formed integral with the ends of the short rib 25. The second protruded blocks 29 are narrow flat blocks extended along the length of the short rib 25. The protruded blocks 28, 29 are respectively connected to the flange 23 in a flush manner. Each of the first protruded blocks 28 is provided with a first mounting hole 31. The first mounting hole 31, as shown in FIG. 1, is comprised of an inside chamber 32 inside the respective first protruded block 28, and an opening 33 cut through the surface of the respective first protruded block 28 in communication with the inside chamber 32. The inside chamber 32 is a narrow flat chamber extended along the length of the respective first protruded block 28. The opening 33 is comprised of a circular insertion portion 34 and an extension portion 35 extended from the circular insertion portion 34 along the length of the respective first protruded block 28 toward the border of the frame base 20. The outer end of the extension portion 35 is spaced from the corresponding end of the inside chamber 32 at a distance. The width of the extension portion 35 is smaller than the diameter of the circular insertion portion 34. The second protruded blocks 29 each is provided with a second mounting hole 36. The shape and structure of the second mounting hole 36 in each second protruded blocks 29 are same as the first mounting holes 31 in the first protruded blocks 28.

The back support 40 is injection-molded from plastics, comprising a supporting base 41 and a coupling portion 42. The supporting base 41 is shaped like a flat plate having a wave-like profile with two straight end edges. The contained angle defined between the extension lines of the straight end edges of the supporting base 41 is an acute angle (see FIG. 2). One straight end edge of the supporting base 41 forms a positioning portion 43. The supporting base 41 has a recessed mounting portion 44 formed of a recessed circular hole and disposed adjacent the positioning portion 43. The coupling portion 42 is formed integral with and extended along one straight end edge of the supporting base 41 remote from the positioning portion 43. The thickness of the coupling portion 42 is greater than the supporting base 41 but smaller than the extension portions 35 of the mounting holes 31, 36. The coupling portion 42 comprises two parallel clamping strips 45 forwardly extended from one end, namely, the inner end in direction along the length of the coupling portion 42 toward the aforesaid contained angle in a perpendicular relationship with the surface of the supporting base 41, a protruded stop portion 46 extended from the other end, namely, the outer end adjacent to the supporting base 41, and a chamfered angle 47 at an outer side of the outer end.

Figure 2:
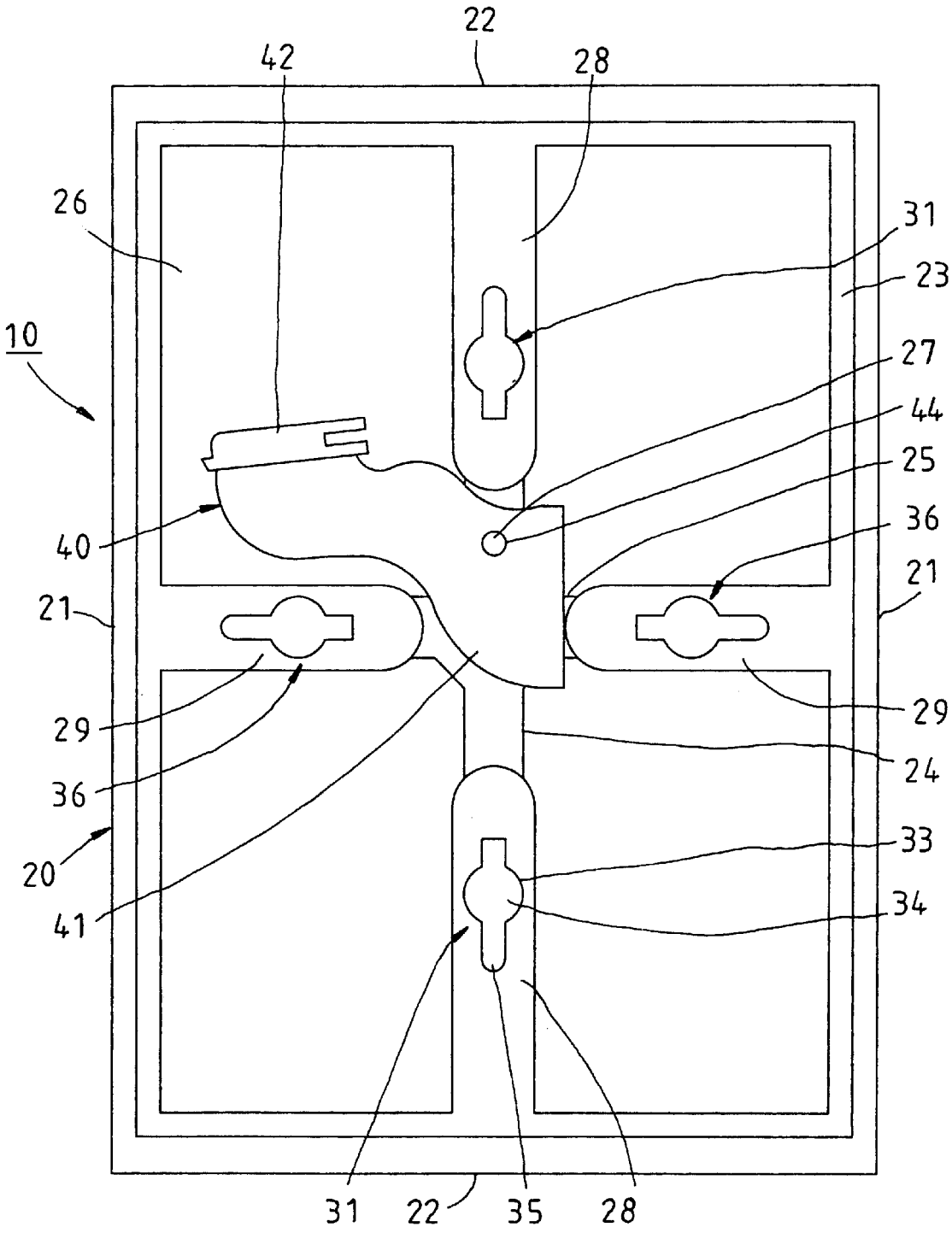
FIG. 2 is a back side view of the picture frame according to the first preferred embodiment of the present invention.

By means of the aforesaid arrangement, the picture frame 10 can be hung on the wall or supported on the table top transversely or longitudinally. When not in use or during transportation, the back support 40 is coupled and closely attached to the back side of the frame base 20. As shown in FIGS. 1 and 2, the recessed mounting portion 44 of the back support 40 is forced into engagement with the peg 27 of the frame base 20, keeping the supporting base 41 spaced between one first protruded block 28 and one second protruded block 29 and suspended in one recessed portion 26. Therefore, the picture frame 10 is arranged in a flat manner, keeping the back support 40 received in one recessed portion 26 in the back side of the frame base 20.

When hanging the frame base 20 on the wall, the back support 40 can be received in one recessed portion 26 in the back side of the frame base 20 or separated from the frame base 20 as desired.

Figure 4:
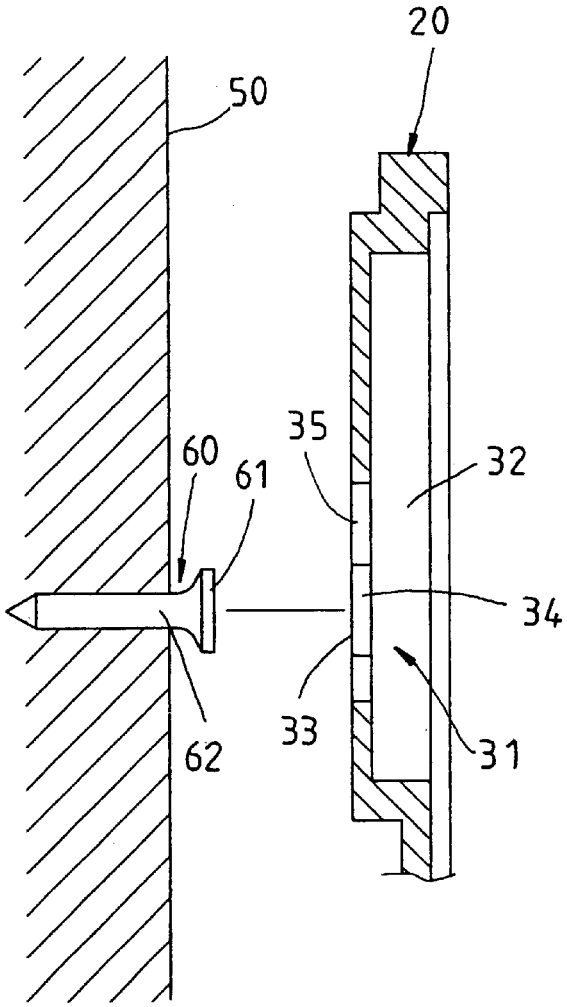
FIGS. 4 and 5 are schematic views showing a wall installation action according to the first embodiment of the present invention
Figure 5:
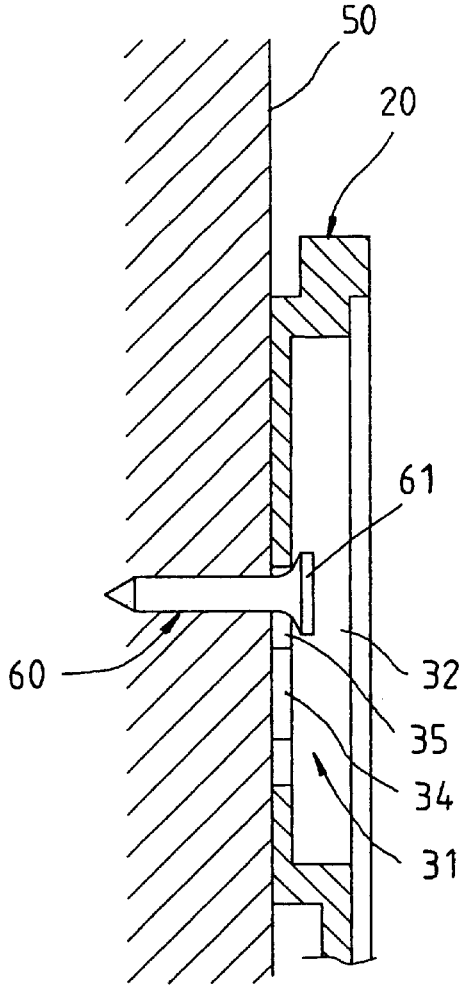

Before hanging the frame base 20, decide the hanging mode to keep the long peripheral sides 21 of the frame base 20 in horizontal or vertical subject to the content of the picture. Hereinafter there is shown an example of the longitudinal hanging mode to keep the long peripheral sides 21 of the frame base 20 in vertical. As illustrated in FIGS. 4 and 5, keep the back side of the frame base 20 facing the wall 50 with the long peripheral sides 21 of the frame base 20 maintained in vertical (not to let the picture turned upside down), and then aim the upper first mounting hole 31 at the nail 60 in the wall 50 (the diameter of the head 61 of the nail 60 is smaller than the circular insertion portion 34 of the opening 33 but greater than the width of the extension portion 35; the diameter of the shank 62 of the nail 60 is smaller than the width of the extension portion 35), and then aim the circular insertion portion 34 of the upper first mounting hole 31 at the nail 60 as shown in FIG. 4. Thereafter, move the frame base 20 toward the wall 50 to let the head 61 of the nail 60 be inserted through the circular insertion portion 34 into the inside chamber 32, and then let the frame base 20 be lowered for enabling the shank 62 of the nail 60 to be moved upwards relative to the frame base 20 along the extension portion 35 so that the head 61 of the nail 60 is finally engaged in the outer (top) end of the extension portion 35, and therefore the frame base 20 is hung on the nail 60 in the wall with the long peripheral sides maintained in vertical as shown in FIG. 5.

When hanging the frame base 20 in a transverse mode, hang one of the second mounting holes 36 on the nail in the wall.

Figure 6:
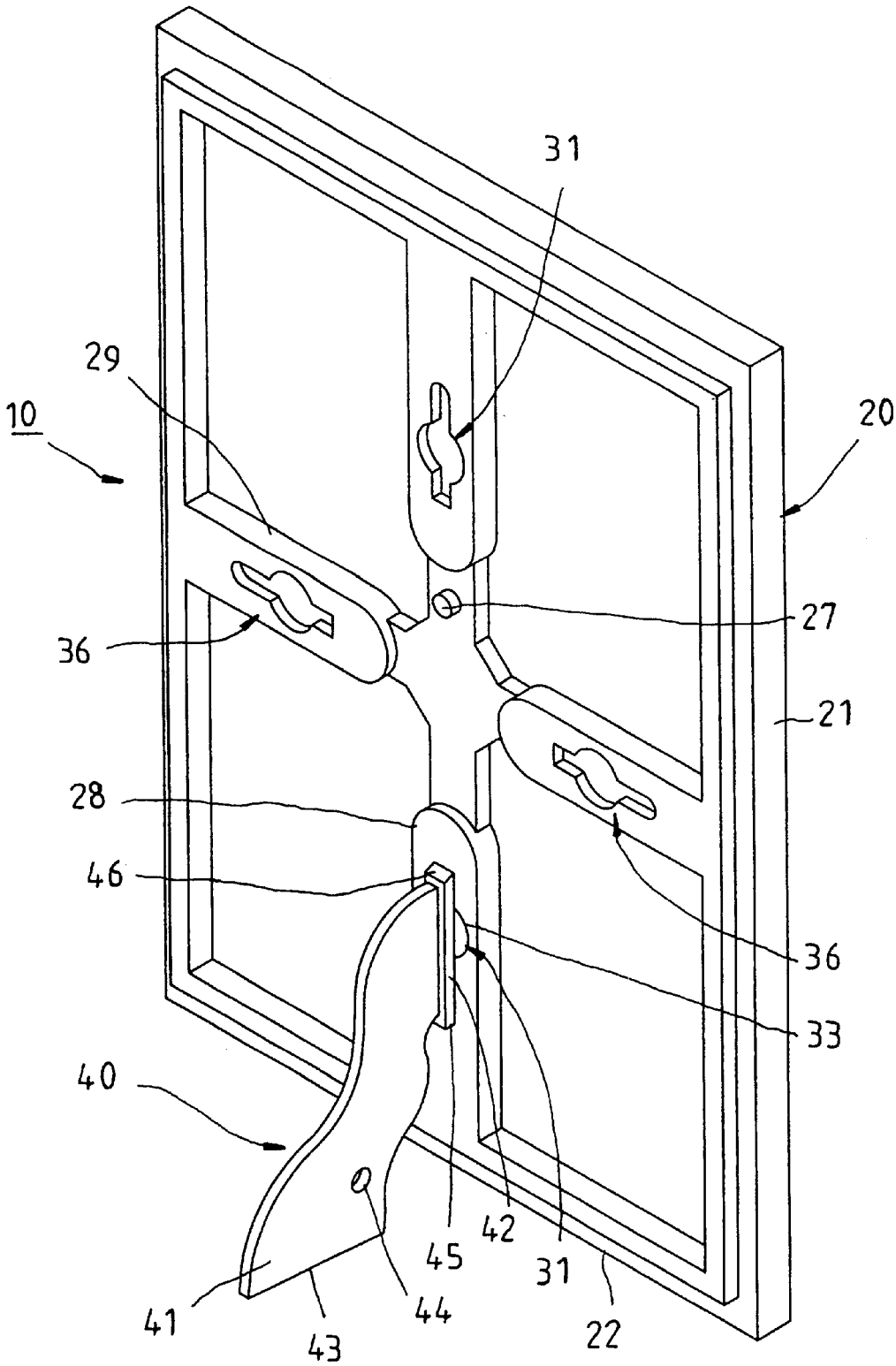
FIG. 6 illustrates the frame base supported on the back support in the longitudinal position according to the first preferred embodiment of the present invention.
Figure 7:
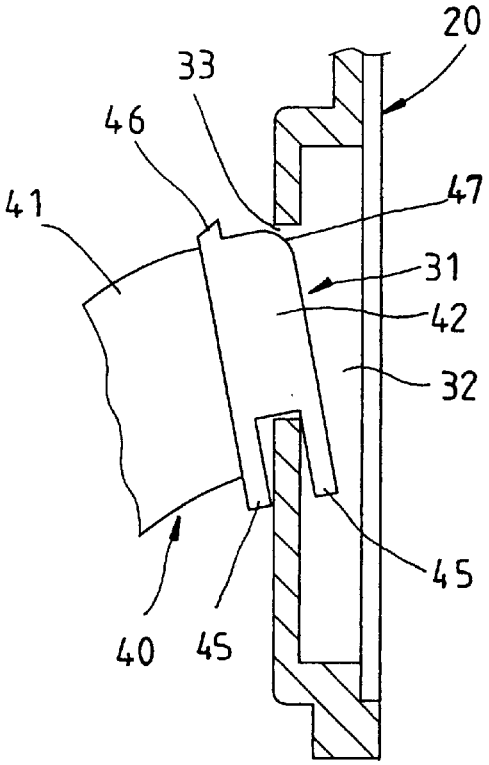
FIGS. 7 and 8 are schematic views showing the connection of the coupling portion of the back support to one mounting hole in the back side of the frame base according to the first preferred embodiment of the present.
Figure 8:
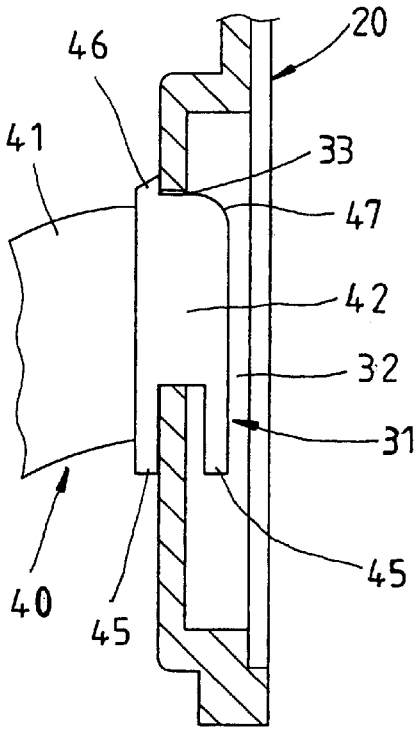

In addition to the aforesaid transverse and longitudinal hanging modes, the picture frame 10 can also be stably positioned on a flat surface transversely or longitudinally as desired. As shown in FIG. 6, the coupling portion 42 of the back support 40 is coupled to the lower first mounting hole 31 of the frame base 20. The coupling procedure is outlined hereinafter with reference to FIGS. 7 and 8. At first, keep the back support 40 in vertical with the coupling portion 42 disposed at the top side and the positioning portion 43 disposed at the bottom side, and then insert one clamping strip 45 of the coupling portion 42 through the opening 33 of the lower first mounting hole 31 into the inside of the inside chamber 32 at an angle, keeping the clamping strips 45 respectively engaged at the inside and outside of the lower first mounting hole 31 (see FIG. 7), and then turn the back support 40 through an angle to force the coupling portion 42 into the inside chamber 32, keeping the stop portion 46 stopped at the outside of the opening 33 (see FIG. 8). The flexible material property and the chamfered angle 47 of the back support 40 facilitate the installation of the coupling portion 42 in the first mounting hole 31.

Referring to FIG. 6 again, after installation of the flat back support 40 in the frame base 20, the flat body of the flat back support 40 is maintained perpendicular to the back side of the frame base 20 and extended backwardly downwards from the corresponding first mounting hole 31, keeping the positioning portion 43 and the bottom edge of the frame base 20 on the same plane. Thus, the back support 40 and the bottom side of the base frame 20 stably support the picture frame 10 on the top of a table or the flat surface of an object. When supported on the top of a table, the contained angle defined by the frame base 20 and the top of the table is an acute angle smaller than 90°, keeping the attached picture slightly tilted. Therefore, the picture frame 10 does not fall when supported on the top of the table.

When supporting the picture frame 10 on the top of the table in transverse direction, fasten the back support 40 to one of the second mounting holes 36.

Figure 9:
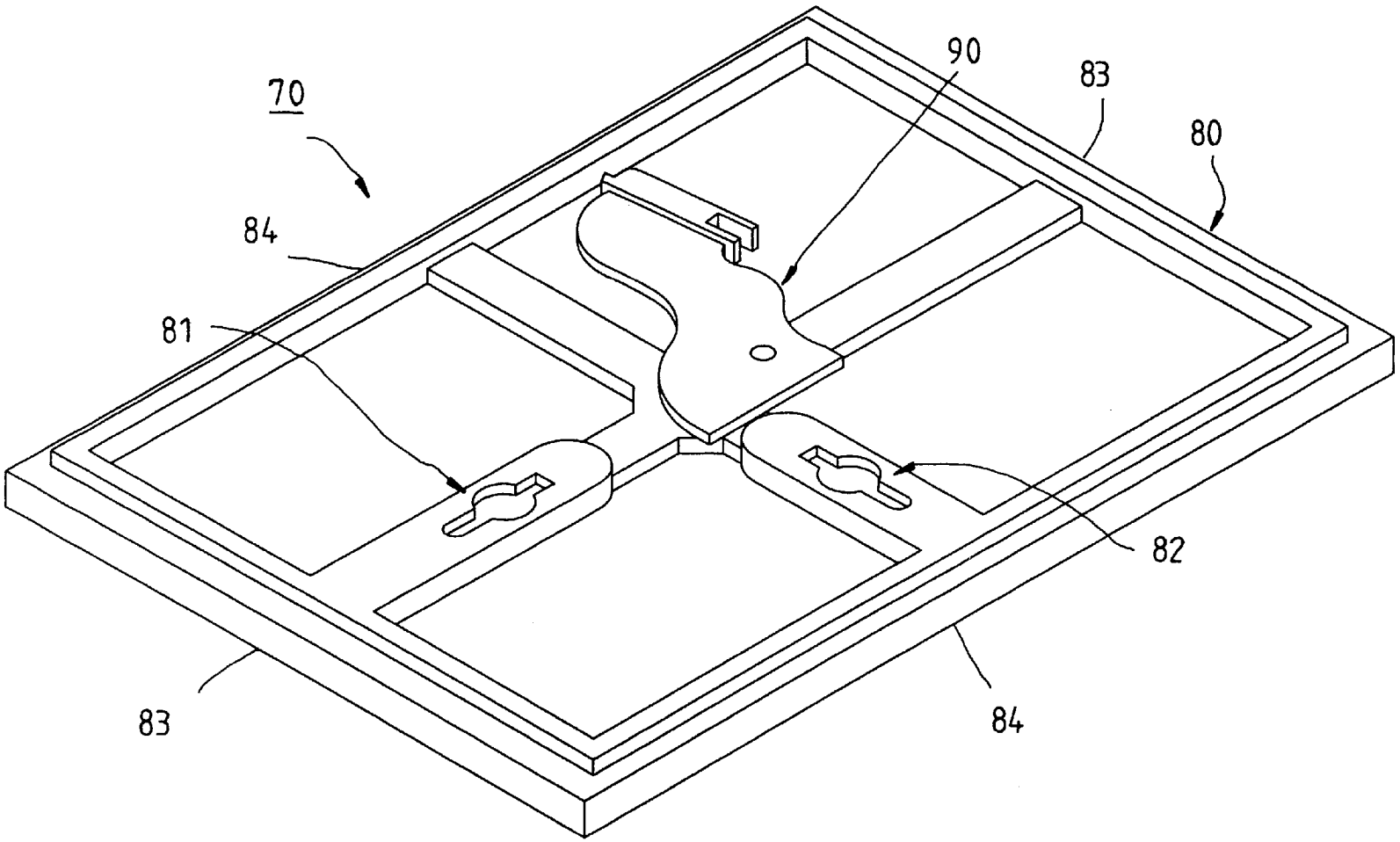
FIG. 9 is a perspective view of a picture frame according to a second preferred embodiment of the present invention.

FIG. 9 shows a second preferred embodiment of the present invention. According to this alternate form, the picture frame 70 is comprised of a frame base 80 and a back support 90. The frame base 80 has only one first mounting hole 81 and one second mounting hole 82. The shape of the mounting holes 81, 82 is same as the aforesaid first embodiment of the present invention, and disposed at locations corresponding to one first mounting hole 31 and one second mounting hole 36 of the aforesaid first embodiment of the present invention, i.e., the first mounting hole 81 is spaced between the center of the frame base 20 and the mid point of one peripheral short side 83, and the second mounting hole 82 is spaced between the center of the frame base 20 and the mid point of one peripheral long side 84. According to this alternate form, the picture 70 can also be alternatively hung on the wall or supported on the top of a table either in transverse direction or longitudinal direction.

If the picture frame 10 of the first embodiment is used, the user needs not to consider the installation direction of the picture relative to the frame base 20 because the frame base 20 has a respective mounting hole in each of the ends of the major axis as well as a respective mounting hole in each of the ends of the minor axis. If the picture frame 70 of the second embodiment is used, the user must consider the installation direction of the picture relative to the frame base 20.

What is claimed is:

1. A multi display mode picture frame comprising:

a flat rectangular frame base having two parallel long peripheral sides, two parallel short peripheral sides, a back side, at least one first mounting hole and at lest one second mounting hole in said back side, each of said at least one first mounting hole being spaced between the center of said back side and the mid point of one of said short peripheral sides, each of said at least one second mounting hole being spaced between the center of said back side and the mid point of one of said long peripheral sides; and a back support having a coupling portion at one end thereof detachably coupled to one of the first and second mounting holes, thereby enabling said back support to be extended from the corresponding mounting hole toward one peripheral side of said frame base which defines with the other end of said back support a triangle that supports the picture frame on a flat surface; and wherein each of said first and second mounting holes is comprised of an inside chamber inside said frame base and an opening in said back side of said frame base in communication with said inside chamber, said opening having an insertion portion and an elongate extension portion extending from said insertion portion toward the border of said frame base, said extension portion having a width smaller than the diameter of said insertion portion; said coupling portion of said back support having two parallel clamping strips extending from one end thereof and a stop portion disposed at an opposite end thereof, said clamping strips being respectively clamped on the inside and outside of the mounting hole of said frame base in which said coupling portion is connected and the stop portion of said coupling portion is stopped outside the opening of the corresponding mounting hole after installation of said coupling portion in the corresponding mounting hole.

2. The multi display mode picture frame as claimed in claim 1, wherein said frame base comprises two first mounting holes respectively bilaterally spaced between the center of said back side of said frame base and the mid points of said short peripheral sides of said frame base, and two second mounting holes respectively bilaterally spaced between the center of said back side of said frame base and the mid points of said long peripheral sides of said frame base.

3. The multi display mode picture frame as claimed in claim 1, wherein said back support comprises a supporting base, said supporting base having two straight end edges, the contained angle defined between extension lines of said straight end edges being an acute angle, one of said straight end edges forming a positioning portion, the other of said straight end edges being fixedly connected to said coupling portion, said parallel clamping strips being forwardly extended from one end toward said contained angle in a perpendicular relationship with said supporting base; said coupling portion of said back support having a chamfered angle disposed at an outer side adjacent to said stop portion.

4. The multi display mode picture frame as claimed in claim 1, wherein said back support is a flat member detachably coupled and closely attached to the back side of said frame base.

5. The multi display mode picture frame as claimed in claim 4, further comprising a recessed mounting portion and a peg respectively provided in said back support and the back side of said frame base and adapted for enabling said back support to be detachably fastened and closely attached to the back side of said frame base by engaging said peg into said recessed mounting portion.

6. The multi display mode picture frame as claimed in claim 5, wherein said frame base further comprises a flange protruded from the back side and extended along the border thereof, a long rib protruded from the back side in parallel to said long peripheral sides, a short rib protruded from the back side in parallel to said short peripheral sides and intersected with said long rib at the center of the back side of said frame base, at least one first protruded block respectively formed integral with said long rib and defining said at least one first mounting hole, and at least one second protruded block respectively formed integral with said short rib and defining said at least one second mounting hole; said peg is formed in one of the long and short ribs adjacent to the center of the back side of said frame base; said back support comprises a supporting base, said supporting base having one end connected to said coupling portion; said recessed mounting portion is formed in said supporting base.

7. A multi display mode picture frame comprising:

a flat rectangular frame base having two parallel long peripheral sides, two parallel short peripheral sides, a back side, at least one first mounting hole and at lest one second mounting hole in said back side, each of said at least one first mounting hole being spaced between the center of said back side and the mid point of one of said short peripheral sides, each of said at least one second mounting hole being spaced between the center of said back side and the mid point of one of said long peripheral sides;

a back support having a coupling portion at one end thereof detachably coupled to one of the first and second mounting holes, thereby enabling said back support to be extended from the corresponding mounting hole toward one peripheral side of said frame base which defines with the other end of said back support a triangle that supports the picture frame on a flat surface;

wherein said back support is a flat member detachably coupled and closely attached to the back side of said frame base; and wherein a recessed mounting portion and a peg are respectively provided in said back support and the back side of said frame base and adapted for enabling said back support to be detachably fastened and closely attached to the back side of said frame base by engaging said peg into said recessed mounting portion.

8. The multi display mode picture frame as claimed in claim 7, wherein said frame base comprises two first mounting holes respectively bilaterally spaced between the center of said back side of said frame base and the mid points of said short peripheral sides of said frame base, and two second mounting holes respectively bilaterally spaced between the center of said back side of said frame base and the mid points of said long peripheral sides of said frame base.

9. The multi display mode picture frame as claimed in claim 7, wherein each of said first and second mounting holes is comprised of an inside chamber inside said frame base and an opening in said back side of said frame base in communication with said inside chamber, said opening having an insertion portion and an elongated extension portion extended from said insertion portion toward the border of said frame base, said extension portion having a width smaller than the diameter of said insertion portion; said coupling portion of said back support having two parallel clamping strips extending from one end thereof and a stop portion disposed at an opposite end thereof, said clamping strips being respectively clamped on the inside and outside of the mounting hole of said frame base in which said coupling portion being connected and the stop portion of said coupling portion is stopped outside the opening of the corresponding mounting hole after installation of said coupling portion in the corresponding mounting hole.

10. The multi display mode picture frame as claimed in claim 9, wherein said back support comprises a supporting base, said supporting base having two straight end edges, the contained angle defined between extension lines of said straight end edges being an acute angle, one of said straight end edges forming a positioning portion, the other of said straight end edges being fixedly connected to said coupling portion, said parallel clamping strips being forwardly extended from one end toward said contained angle in a perpendicular relationship with said supporting base; said coupling portion of said back support having a chamfered angle disposed at an outer side adjacent to said stop portion.

11. The multi display mode picture frame as claimed in claim 7, wherein said frame base further comprises a flange protruded from the back side and extended along the border thereof, a long rib protruded from the back side in parallel to said long peripheral sides, a short rib protruded from the back side in parallel to said short peripheral sides and intersected with said long rib at the center of the back side of said frame base, at least one first protruded block respectively formed integral with said long rib and defining said at least one first mounting hole, and at least one second protruded block respectively formed integral with said short rib and defining said at least one second mounting hole; said peg is formed in one of the long and short ribs adjacent to the center of the back side of said frame base; said back support comprises a supporting base, said supporting base having one end connected to said coupling portion; said recessed mounting portion is formed in said supporting base.

* * * * *